US006550890B2

(12) United States Patent
Saijo

(10) Patent No.: US 6,550,890 B2
(45) **Date of Patent: *Apr. 22, 2003**

(54) INK JET PRINTING APPARATUS

(75) Inventor: Yasutsugu Saijo, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/406,722

(22) Filed: Sep. 28, 1999

(65) Prior Publication Data

US 2002/0130920 A1 Sep. 19, 2002

(30) Foreign Application Priority Data

Sep. 29, 1998 (JP) ..... 10-276016

(51) Int. Cl.[7] ..... B41J 2/165
(52) U.S. Cl. ..... 347/29; 347/30; 347/31
(58) Field of Search ..... 342/29, 30, 31

(56) References Cited

U.S. PATENT DOCUMENTS

| | | | | |
|---|---|---|---|---|
| 4,313,124 A | | 1/1982 | Hara | 347/75 |
| 4,345,262 A | | 8/1982 | Shirato et al. | 347/75 |
| 4,459,600 A | | 7/1984 | Sato et al. | 347/75 |
| 4,463,359 A | | 7/1984 | Ayata et al. | 347/75 |
| 4,543,589 A | * | 9/1985 | Terasawa | 347/31 |
| 4,558,333 A | | 12/1985 | Sugitani et al. | 347/75 |
| 4,723,129 A | | 2/1988 | Endo et al. | 347/75 |
| 4,740,796 A | | 4/1988 | Endo et al. | 347/75 |
| 5,508,722 A | * | 4/1996 | Saito et al. | 347/17 |

FOREIGN PATENT DOCUMENTS

| | | | | |
|---|---|---|---|---|
| EP | 0 744 294 A1 | * | 11/1996 | 347/29 |
| JP | 54-56847 | | 5/1979 | |
| JP | 59-123670 | | 7/1984 | |
| JP | 59-138461 | | 8/1984 | |
| JP | 60-71260 | | 4/1985 | |
| JP | 10-211707 | | 8/1998 | |
| JP | 11-138855 | | 5/1999 | |

* cited by examiner

*Primary Examiner*—Shih-wen Hsieh
(74) *Attorney, Agent, or Firm*—Fitzpatrick, Cella, Harper & Scinto

(57) ABSTRACT

An ink jet printing apparatus including a cap for capping ink orifices provided on a head face of an ink jet print head, an in-cap absorbing body disposed in the cap, the in-cap absorbing body not contacting the head face during capping by the cap, and a suction means for sucking ink from the ink orifices through the cap. The in-cap absorbing body has an end surface which is nearest to the head face during capping by the cap and a lower surface which is farther from the head face during capping by the cap than the end surface, and the cap has a space formed along substantially an entire circumference of a head engagement portion of the cap between the end surface of the in-cap absorbing body and the head engagement portion of the cap.

13 Claims, 11 Drawing Sheets

INK JET PRINTING APPARATUS

This application is based on Patent Application No. 10-276016 filed Sep. 29, 1998 in Japan, the content of which is incorporated hereinto by reference.

BACKGROUND OF THE INVENTION

Field of the Invention

The present invention relates to an ink jet printing apparatus and more specifically to an ink jet printing apparatus having an improved recovery device for recovering or keeping in good condition an ink ejection performance of an ink jet print head.

Printing apparatus for printing a print sheet (also referred to simply as "recording paper"), such as paper, cloth, plastic sheet and OHP sheet, are being proposed in a construction capable of mounting print heads of various systems, including, for example, a wire dot system, a thermosensitive system, a heat transfer system and an ink jet system.

Of these printing apparatus, an ink jet printing apparatus (also referred to as an ink jet printer) that ejects ink from ink orifices to print on recording paper is a low-noise, non-impact type printing system and can perform a high-density, high-speed printing operation.

Generally, an ink jet printing apparatus has a means for driving a print head carrier, a means for feeding recording paper, and a means for controlling these means.

There are several types of energy generating elements for generating energy used to eject ink from orifices of the print head. They include an element that uses an electromechanical transducer such as piezoelectric material, an element which radiates electromagnetic waves such as laser to heat ink to eject an ink droplet by the action of heat, and an element that uses an electrothermal transducer having a heating resistor to heat the liquid.

A print head of an ink jet print system that ejects ink droplets by thermal energy is capable of printing at high resolution because the ink orifices can be arranged at high density. In the ink jet print system, a print head using the electrothermal transducer as an energy generating element is advantageous because it can easily be reduced in size and manufactured by fully utilizing the advantages of IC technology and microfabrication technique in the semiconductor field whose technical progress and reliability improvement are remarkable in recent years and because it can easily be increased in integration density and its production cost is low.

As described above, though it is an excellent print system simple in construction, the ink jet print system has problems that need to be solved.

One of the problems is stains formed around ink orifices on that surface (hereinafter referred to as a head face) of the print head which faces the print medium and in which ink orifices are formed. There are mainly two causes for the stains. A first cause for the stains is that when ink ejected for printing strikes the print paper, a part of the ink fails to adhere to the paper and bounces off. Further, when ink is ejected, miniscule ink particles, other than the main ink droplets contributing to the printing, may be formed and float in the air. These ink particles adhere to the head face, forming stains.

A second cause for the stains is ink droplets remaining on the head face during an ejection performance recovery operation, in which a cap is put on the head face to draw ink by suction from within the ink orifices in order to prevent clogging of the ink orifices and then is removed from the head face. When ink is drawn by suction, the cap is filled with ink. When in this condition the cap is removed from the head face, the ink in contact with the head face remains there. To prevent this, the head face may be treated with a liquid repulsive coating but this cannot expel residual ink completely.

Further, to remove ink remaining in the cap when the cap is taken off the head face after the ejection performance recovery operation is performed on the ink orifices, an thin plate-like absorbing body made of porous resin or nonwoven cloth is installed in the cap. If the absorbing body is not provided in the cap, when, with the cap open, the suction is performed to remove ink from the cap, only the ink in the immediate vicinity of the discharge port in the cap is drawn out, leaving the link at the surrounding areas. That is, the use of the absorbing body allows a negative pressure to act slowly so that the ink in the cap is drawn out by suction uniformly.

When unwanted ink droplets adhere to around the ink orifices, troubles occur, such as a so-called "kink" in which the ink ejection direction deviates from the intended direction and an "ejection failures" in which ink cannot be ejected at all, degrading the print quality.

To solve this problem, a method is often adopted which wipes the head face with a blade (or wiper) as a wiping member made of an elastic material such as rubber (this operation is also referred to as "wiping"). The wiping method includes one which scans the print head with respect to a stationary blade to wipe the head face by the blade and one which holds the print head immovable and advances or pivots the blade to bring it into contact with the head face.

To prevent the blade and the print head from contacting each other unnecessarily hard, the former method may support the blade so as to be projectable toward the print head and set the blade in a projected position during the scanning of the print head in one direction only and in a retracted position during the scanning in the opposite direction. The latter method may reciprocally advance or reciprocally pivot the blade extending in a direction perpendicular to the main scan direction and properly advance or retract the print head to and from the blade scanning position. When the wiping is to be performed only during the forward movement for example, the print head is set at the corresponding position and, during the return movement, is retracted from that position.

However, when residual ink remains on the head face in large quantity, a large amount of ink will adhere to the head face wiping blade. As a result, when a means for cleaning the blade (cleaner) is provided, a large quantity of ink will adhere to the cleaner. This raises another problem of disposing of the ink wiped by the blade and of processing an ink receiving member such as cleaner.

Among the technologies that solve these problems and reduce the amount of ink remaining on the head face following the ink ejection performance recovery operation is Japanese patent Application Laying-open No. 11-138855 laid-opened on May 25, 1999.

Although the invention of the Japanese patent Application Laying-open No. 11-138855 (1999) can reduce the amount of ink remaining on the head face after the ejection performance recovery operation, a small amount of grain-like ink is found remaining in a case where there is a relative positional relationship between the cap and the in-cap absorbing body. In such a case it is known that ink often remains when the head engagement portion of the cap and the end portions of that surface of the ink absorbing body in the cap which is parallel to and nearest to the head face are close to each other.

OBJECT OF THE INVENTION

To solve these problems experienced with the conventional systems it is an object of the present invention to provide an ink jet printing apparatus with an ejection performance recovery device which secures a predetermined space between the surface of the in-cap absorbing body facing the head face and the head engagement surface of the cap.

SUMMARY OF THE INVENTION

In the first aspect of the present invention, there is provided an ink jet printing apparatus comprising, a cap for capping ink orifices provided on a head face of an ink jet print head, an in-cap absorbing body disposed in the cap, and a suction means for sucking ink from the ink orifices through the cap, wherein the cap has a space formed along almost an entire circumference of a head engagement portion of the cap between an end surface of the in-cap absorbing body which is nearest to the head face and the head engagement portion of the cap.

Here, position restriction portions for the in-cap absorbing body may be provided in the cap and extend toward the end surface of the in-cap absorbing body.

Position restriction portions for the in-cap absorbing body may be formed integral with the in-cap absorbing body at location near the end surface of the in-cap absorbing body.

The height of the position restriction portions for the in-cap absorbing body may be lower than that of the end surface of the in-cap absorbing body.

A surface which is one step lower in height than the end surface of the in-cap absorbing body may be formed along an entire circumference of the in-cap absorbing body outside the end surface of the in-cap absorbing body.

A height of a portion of the in-cap absorbing body facing the ink orifices of the ink jet print head may be lower than that of the end surface of the in-cap absorbing body.

A portion of the in-cap absorbing body facing an array of the ink orifices of the ink jet print head and a portion of the in-cap absorbing body restricted by the position restriction portions may be lower in height than the end surface of the in-cap absorbing body and the position restriction portions may be provided on the in-cap absorbing body or on the cap at longitudinal ends of the in-cap absorbing body.

The in-cap absorbing body may be formed of a porous material.

The ink jet print head may have an electrothermal transducer for generating thermal energy to eject ink.

The ink jet print head may use thermal energy to generate a bubble based on a film-boiling in ink to eject an ink droplet.

In the second aspect of the present invention, there is provided a cap of an ink jet print head for capping a head face of the ink jet print head provided with an in-cap absorbing body installed in an interior thereof, wherein the cap has a space formed along almost an entire circumference of a head engagement portion of the cap between an end surface of the in-cap absorbing body which is nearest to the head face and the head engagement portion of the cap.

According to the ink jet printing apparatus of the present invention with the construction described above, a predetermined space is provided between the ends of that surface of the in-cap absorbing body which is parallel to and nearest to the head face and the head engagement portion of the cap. This construction can prevent ink from accumulating in small gaps between the ends of the in-cap absorbing body and the head engagement portion of the cap by the action of capillary attraction when the cap is open after the suction operation. This in turn prevents ink droplets from remaining on the head face and from being inadvertently transferred onto the print paper, and also reduces the total amount of ink that is wiped off by the next wiping operation. As a result, it is possible to prevent ink from being scattered from the wiping blade and blade cleaner into the interior of the apparatus, to reduce the amount of ink forced into the ink orifices during the wiping operation, and to reduce the amount of preliminary ejection ink required to discharge the forced-in residual ink from the orifices.

This space can be secured by forming in the cap the position restriction portions for the in-cap absorbing body that extend toward the ends of that surface of the in-cap absorbing body which is parallel to and nearest to the head face. The provision of this space ensures the above-described advantages.

Further, because the position restriction portions for the in-cap absorbing body are formed integral with the in-cap absorbing body at locations near the ends of that surface of the in-cap absorbing body which is parallel to and nearest to the head face, the position restriction portions can have an ink absorbing capability, thereby preventing more effectively the ink droplets from remaining on the head face and from being transferred onto the print paper.

Further, because the height of the position restriction portions of the in-cap absorbing body is set lower than that of the surface of the in-cap absorbing body parallel to and nearest to the head face, a space can be secured in the vertical direction (i.e., in the direction of thickness of the absorbing body) near the cap head engagement portions, thus further enhancing the above-mentioned advantages.

In addition, because a surface which is one step lower in height than the surface of the in-cap absorbing body parallel to and nearest to the head face is formed along an entire circumference of the in-cap absorbing body outside the surface of the in-cap absorbing body parallel to and nearest to the head face, it is possible to secure the space near and along the entire circumference of the head engagement portion of the cap, thereby reducing the amount of residual ink droplets which might be transferred onto the print paper.

Further, because at least a portion of the in-cap absorbing body facing an array of the ink orifices of the ink jet print head is set one step lower in height than the surface of the in-cap absorbing body parallel to and nearest to the head face, it is possible to prevent the in-cap absorbing body from directly contacting the nozzle portion of the head and degrading the ejection performance of the head. At the same time, because the in-cap absorbing body is formed to have a raised surface at a location near the ink orifices from which ink is ejected, the capability to collect residual ink is maintained and improved.

Further, the portion of the in-cap absorbing body facing an array of the ink orifices of the ink jet print head and a portion of the in-cap absorbing body restricted by the position restriction portions are set lower in height than the surface of the in-cap absorbing body nearest to the head face, and the position restriction portions are provided on the in-cap absorbing body or on the cap at longitudinal ends of the in-cap absorbing body. In this construction, the cross section of the in-cap absorbing body taken along a direction perpendicular to the array of ink orifices is basically the same at any position, except for a part of the longitudinal ends of the in-cap absorbing body when the position restriction portions for the in-cap absorbing body are provided. Hence, the in-cap absorbing body can be made by using a simple die structure whether it is formed by an extrusion method or a sintering method which heats powder filled in a die. The simple die structure facilitates the filling of material, improving the productivity of the in-cap absorbing body. In addition, this construction offers the advantages of being able to minimize the amount of residual ink droplets on the head face which may be transferred onto the print paper.

Further, because the in-cap absorbing body is made of a porous material, the ink can be properly absorbed.

Because the ink jet printing apparatus using an ink jet print head for printing comprises a cap and an ejection performance recovery means for recovering an ink ejection performance of the ink jet print head by drawing ink out of ink orifices of the print head with the print head capped by the cap, the ejection performance recovery operation can be performed through the cap satisfactorily.

Because the ejection performance recovery means has a means for applying a suction force through the cap to draw ink from the ink orifices, the ink can be properly discharged without contaminating the surroundings.

Further, because the ink jet print head has an electrothermal transducer that transforms applied electricity into thermal energy used to eject ink droplets, the ink ejection can be done properly to produce a clear printed image.

Furthermore, because the ink jet print head utilizes the film boiling in the ink caused by the thermal energy produced by the electrothermal transducer in order to eject ink droplets from the ink orifices onto the print medium, the printing can be performed well producing a clear printed image.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Now, an ink jet printing apparatus of the present invention will be described in detail by referring to the accompanying drawings.

(Outline of the Apparatus)

Figure 1:
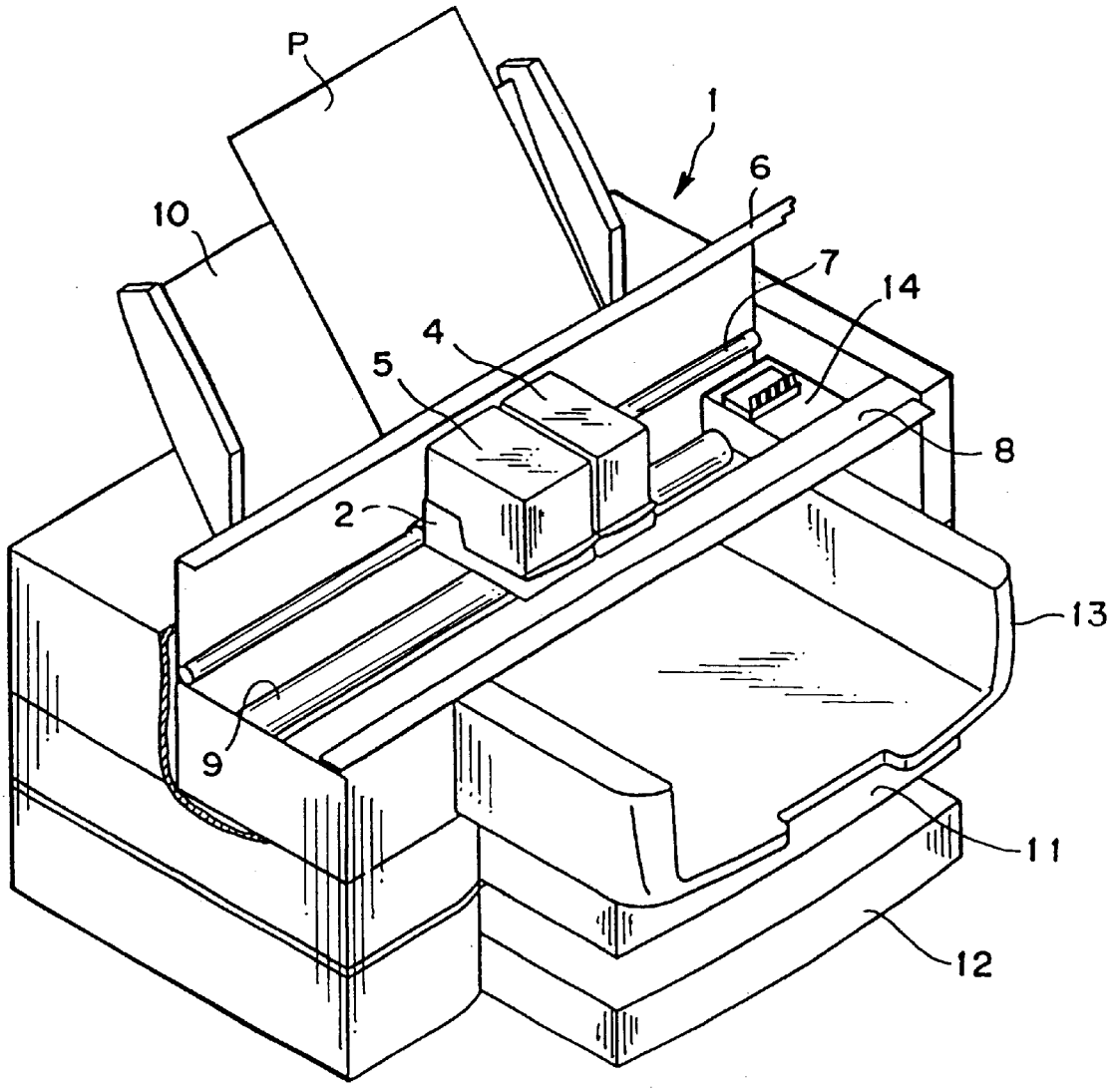
FIG. 1 is a perspective view showing an example outline configuration of an ink jet printing apparatus according to one embodiment of this invention.

FIG. 1 is an outline perspective view showing an example overall construction of an ink jet printing apparatus (represented by reference number 1) according to one embodiment of this invention. A carrier 2 has a removable head cartridge 5, which includes an ink jet print head 3 (not shown in FIG. 1 and located at the back of an ink tank 4 described later) constituting a print means and an ink tank 4. This carrier 2 is mounted on a guide shaft 7 and a guide rail 8, both of which are arranged parallel to each other and secured at their ends to a frame 6, so that it can be slid along the guide shaft 7 and guide rail 8. The carrier 2 is reciprocally moved by a belt drive unit and a rotary drive source such as stepping motor, both not shown.

Print paper P is gripped and fed by a feed roller 9 and a pinch roller (not shown) engaging the feed roller 9. Paper is fed to the printing mechanism either from an auto sheet feeder 10, an upper cassette 11 or a lower cassette 12.

Designated 14 is an ejection performance recovery device, which, during a standby state waiting for a print command or at an appropriate timing during, before or after the printing operation, performs operations to recover the performance of the ink jet print head 3 or to keep it in good condition (such as capping, suction and wiping).

This embodiment has an electrothermal transducer for generating heat energy to eject ink. The transducer is applied electricity to generate heat corresponding to the amount of electric current applied to cause a status change in the ink, accompanied by film boiling, thereby ejecting ink droplets. The ink jet print heads can be provided in numbers corresponding to the number of inks with different colors and densities (hereinafter referred to as tones). It is also possible to form the print head as a one-piece structure for a plurality of tones or as a structure having individual ejection portions for the corresponding tones. Further, the ejection portion may have a plurality of ink orifices arranged in an appropriate direction.

(Construction and Operation of the Ejection Recovery Device)

Figure 2:
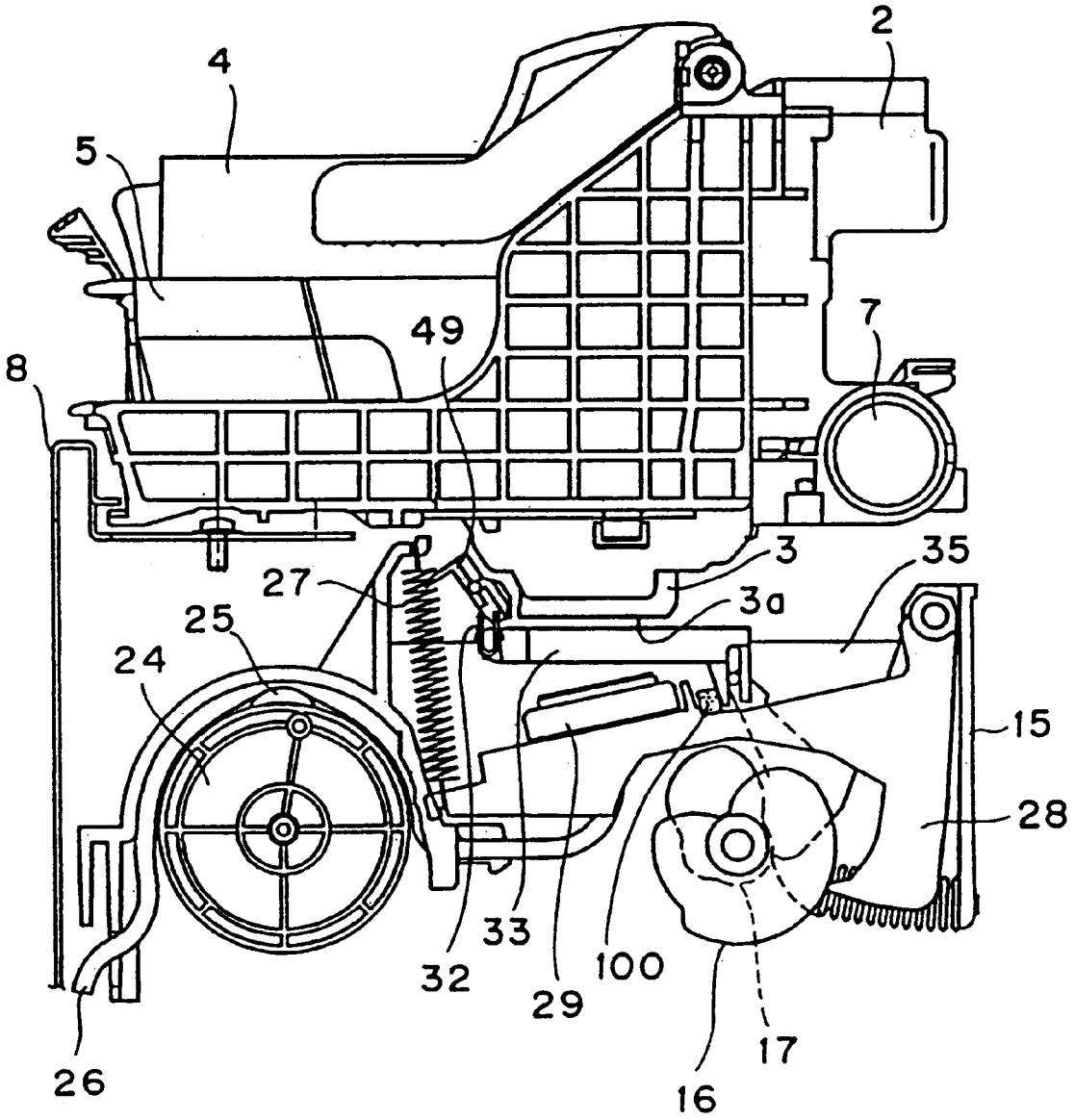
FIG. 2 is a schematic cross section of an example construction of an ejection performance recovery device applicable to the ink jet printing apparatus of FIG. 1.
Figure 3:
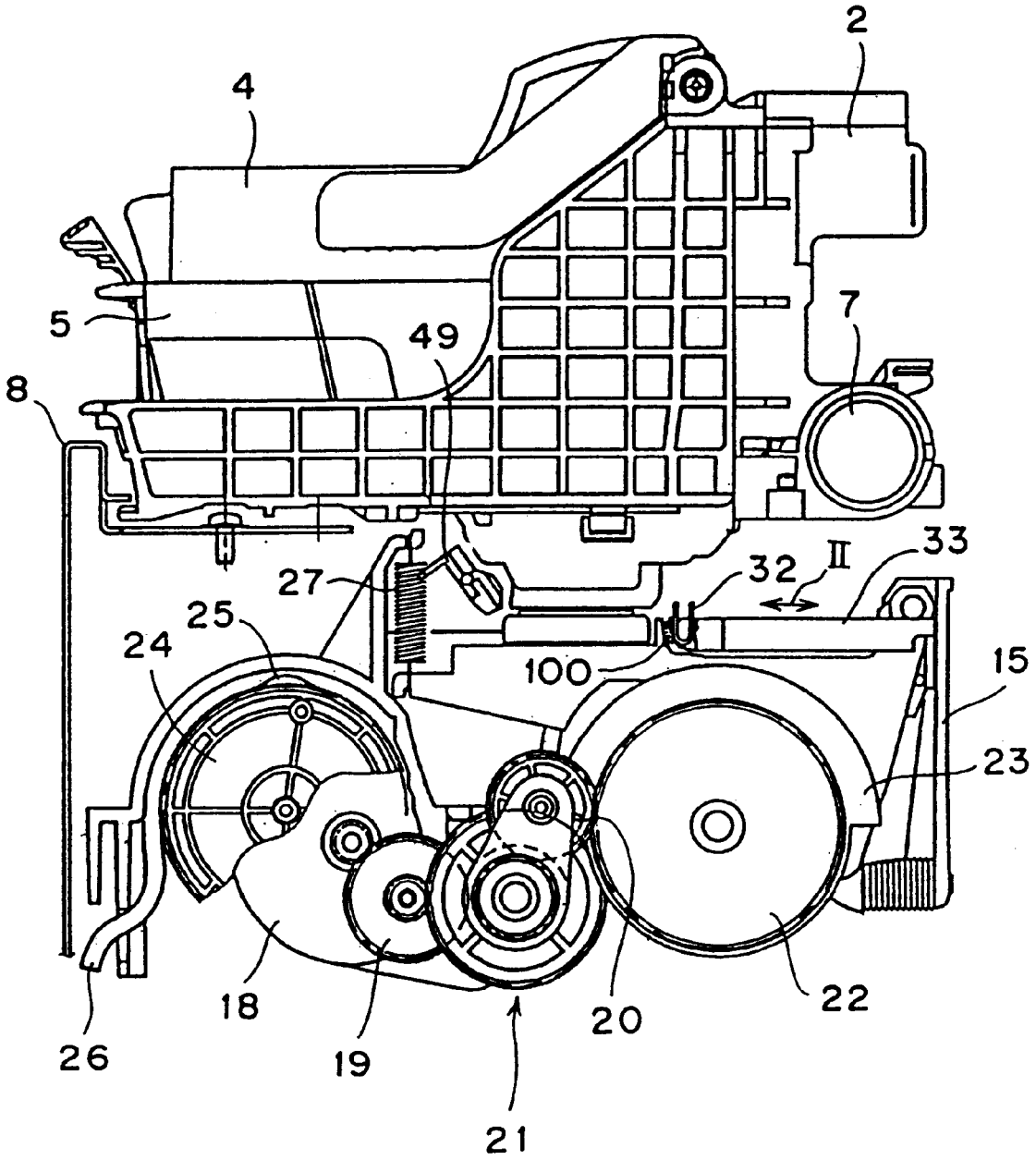
FIG. 3 is a schematic cross section of an example construction of a drive force transmission system for transmitting drive forces to parts of the ejection performance recovery device of FIG. 2.
Figure 4:
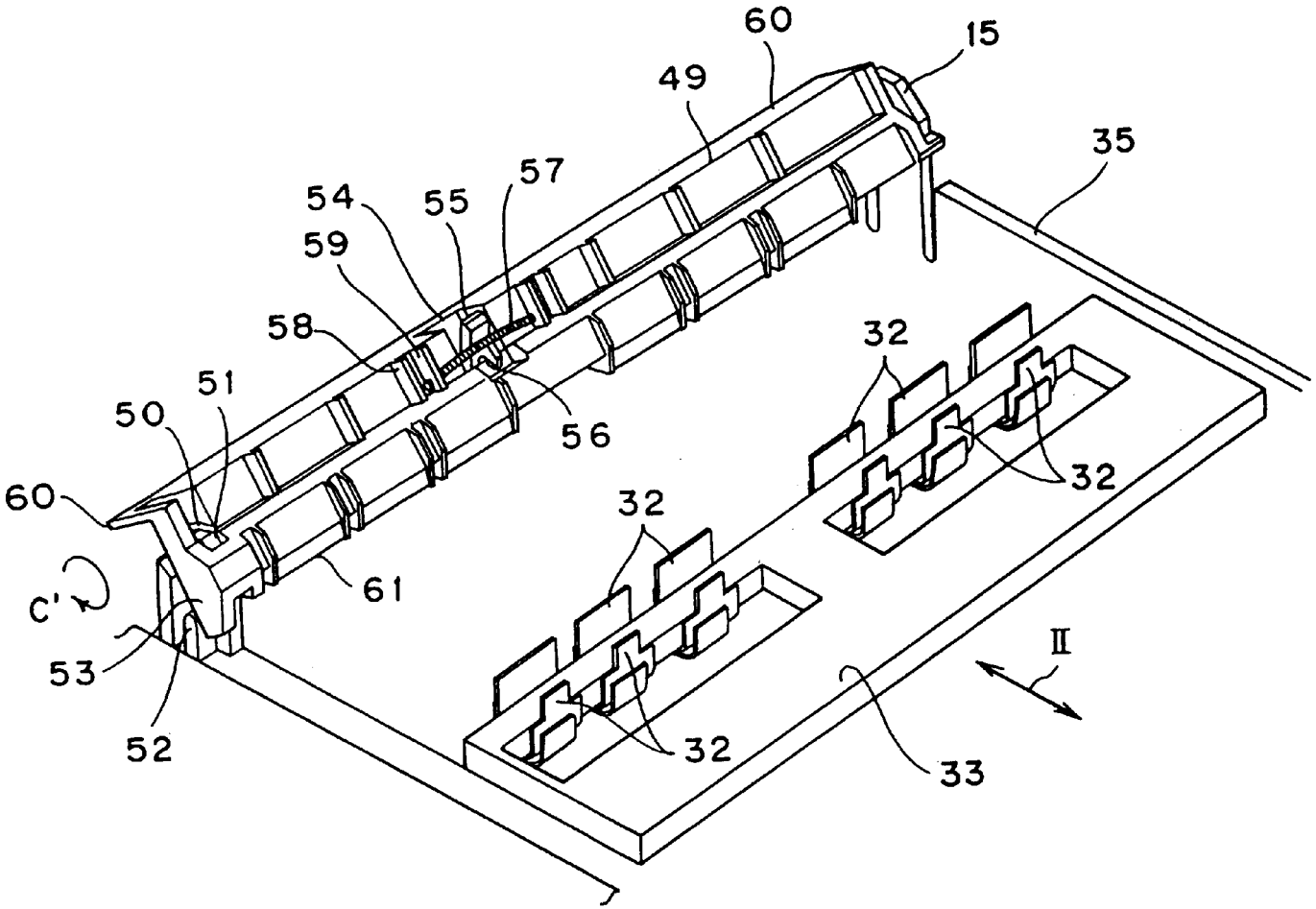
FIG. 4 is an outline perspective view showing the construction of a blade and a blade cleaner used in the embodiment of this invention.

Next, the ejection performance recovery device 14 will be explained in more detail by referring to FIGS. 2 to 9. FIGS. 2 and 3 are schematic cross sections showing an example construction and operation of cap, blade, pump and others provided in the ejection performance recovery device of this embodiment. FIG. 4 is a schematic perspective view showing the relation between the blade and the blade cleaner, and FIGS. 5 to 9 are schematic cross sections showing a blade drive mechanism.

In FIG. 2, the ink jet print head 3 is scanned in a direction perpendicular to the surface of the drawing (in a main scan direction). Denoted 3*a* is a head face which is opposed to a print medium and has a plurality of ink orifices opening toward the print medium. Designated 15 is a part of the base that supports individual portions of the ejection performance recovery device. Only those portions necessary for explanation are shown.

A cap cam 16 and a brake cam 17, which is coaxial with and rotated together with the cap cam 16 and adapted to apply a braking force to hold an appropriate rotating state of the cap cam, are both driven by a stepping motor 18 of FIG. 3 whose drive force is transmitted to a cam gear 22 through a reduction gear 19 and a pendulum transmission mechanism 21 including a planetary gear 20. A cam gear flag 23 functions as a light shielding plate for an optical sensor not shown and is used to determine the phase of the cam.

When the stepping motor 18 is driven counterclockwise (backwardly) in FIG. 3, the planetary gear 20 swings to the left in the figure to mesh with a gear portion of a pump roll holder 24 and rotate it. The pump roll holder 24, as shown in FIG. 2, rotatably supports a pump roll 25. When the pump roll holder 24 rotates, the pump roll 25 moves and crushes a suction tube 26 as it rotates on its axis. This operation is performed in a capping state to draw ink by suction from the orifices of the ink jet print head 3.

On the other hand, when the stepping motor 18 is rotated clockwise (forwardly) in FIG. 3, the planetary gear 20 swings to the right in the figure to engage the cam gear 22 and rotate it clockwise to cause the cap cam 16 to rotate. At this time a cap arm 28 urged by a cap arm spring 27 and serving as a cam follower for the cap cam 16 oscillates, causing the cap 29 to open and close the ink jet print head 3.

Denoted 100 is an arm absorbing body bonded to the cap arm 28 which is used to absorb ink collected at the lower part of the blade 32. The arm absorbing body 100 may use any appropriate material as long as it has a liquid absorbing property, for example, a fiber body such as resin, felt and nonwoven cloth and a porous material such as sponge. A sponge of hydrophilic melamine resins is preferable because it can efficiently absorb ink and is easily compressible. The detailed operation of the arm absorbing body 100 will be described later.

Next, the construction and operation of the blade 32 will be described.

In FIGS. 2 and 3, the blade 32 for wiping the head face 3*a* is attached to a blade holder 33, which is reciprocally guided in the lateral direction in FIG. 2 along a guide portion 35 of a base 15 that supports various components. In the example shown, the blade 32 is roughly U-shaped in cross section and the front ends of two nearly flat, rectangle blade portions wipe and clean the head face 3*a* of the ink jet print head 3. The blade 32 may have only one blade portion or three or more blade portions depending on the configuration and performance of the ink jet print head 3. The blade 32 may also be shaped into other forms than the U-shape in cross section. For example, it may have a plurality of blade portions arranged parallel to each other at appropriate intervals. The blade 32 may also be made of any appropriate material including rubber such as synthetic rubber and silicone rubber or elastomer, or appropriate plastic material having a required elasticity. The blade holder 33, as shown in FIG. 4, has the same number of blades 32 (in this embodiment, six) as that of the ink jet print heads 3 mounted on the carriage (or the number of the predetermined ink orifice groups provided one for each ink color and density). The blade holder 33 is reciprocally driven along the guide portion 35 of the base 15 in a direction of arrow II by an activating mechanism 36.

Figure 5:
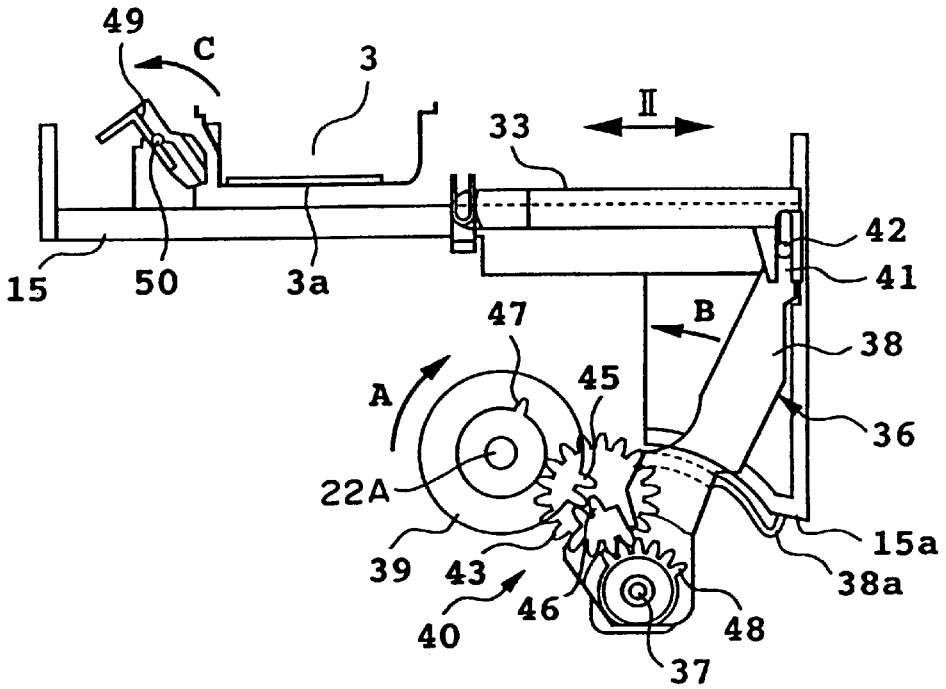
FIG. 5 is a schematic cross section showing the operation of the blade according to the embodiment of this invention.

As shown in FIG. 5, the activating mechanism 36 for reciprocally driving the blade holder 33 is pivotally supported on the base 15 by a pivot shaft 37 and comprises: a blade arm 38 with one end connected to the blade holder 33; and a gear mechanism 40 for transferring a drive force from the drive gear 39 driven by the stepping motor 18 to the blade arm 38. The blade arm 38 is connected to the blade holder 33 by the engagement between a slot 41 of the blade holder 33 and a pin 42 provided at the front end of the blade holder 33.

The gear mechanism 40 for transferring a drive force of the stepping motor 18 to the blade arm 38 generally comprises: the drive gear 39 arranged coaxial with and rotated together with a support shaft 22A of the cam gear 22; an idle gear 43 for driving the blade arm 38; and a gear portion 44 integrally mounted to around the end of the blade arm 38 on the pivot shaft 37 side. When the blade arm is moved in the forward direction, i.e., in the direction of arrow B in the figure, a forward gear portion 45 of the drive gear 39 and a forward gear portion 46 of the gear portion 44 are meshed together. When on the other hand the blade arm is moved in the backward direction, i.e., in a direction opposite the arrow B in the figure, a backward gear portion 47 of the drive gear 39 is connected with a backward gear portion 48 of the gear portion 44 through the idle gear 43.

The gear portions 46 and 48 on the blade arm 38 side and the gear portions 45 and 47 on the drive gear 39 side are formed with teeth only at necessary locations so that the drive force can be transferred to the blade arm 38 only when necessary. The rotation of the drive gear 39 in the direction of arrow A causes the blade arm 38 to be pivoted reciprocally and as this motion is transmitted through the engagement portion of the slot 41 and the pin 42, the blades 32 and the blade holder 33 are reciprocally moved parallelly.

A blade cleaner 49 for cleaning the blades 32 by wiping off the adhering ink extends in a range nearly corresponding to the blade array range and is pivotally supported on the base 15. That is, as shown in FIGS. 4 and 5, the blade cleaner 49 is shaped almost like an inverted letter V in cross section. At the ends of the extension range of the blade cleaner 49 there are provided shaft portions 50 which are engaged in bearing portions 51 of the base 15 so that the blade cleaner 49 is pivotally supported.

The base 15 is provided with a stopper 52 which limits the pivotal motion of the blade cleaner 49 in such a way that the blade cleaner 49 can pivot in one direction but not in the opposite direction. The stopper 52 engages an abutting portion 53 of the blade cleaner 49 and blocks further movement of the blade cleaner 49 in the direction of arrow C'.

The central part of the blade cleaner 49 is formed with a notch portion 54, through which a stay 55 of the base 15 extends. The front end of the stay 55 engages, from above, with the blade cleaner 49 near its rotation axis and supports the central part of the elongate blade cleaner 49 so that the rotating load can be minimized. For this reason, an engagement portion 56 of the central part of the blade cleaner 49 for the stay 55 is so shaped as to become narrow toward the end like a rib.

A spring 57 urges the blade cleaner 49 to abut against the stopper 52. In this example, the spring 57 is formed of a tight coil spring and is shaped like a general tight coil spring with the spring hook portions at both ends removed. The spring 57 is arranged on the upper side of the stay 55 at the central part of the blade cleaner 49. The ends of the spring 57 are inserted into mounting portions 59 provided in walls 58 of the blade cleaner 49 so that the spring 57 does not move in the axial direction nor in the radial direction more than a predetermined play but are free to rotate. The spring 57 may also be arranged above the rotating center of the blade cleaner 49 and when the blade cleaner is pivoted in the direction of arrow C, the mounting portions 59 move downward away from the position almost facing the spring hook portions of the stay 55, with the result that a raised part of the spring 57, which is initially shaped like a moderate hill, increases its height or deformation, producing an increased reactionary force and an urging force.

The blade cleaner 49 is also provided with an impact portion 60 shaped like an eave to prevent upward scattering of ink. Because of this impact portion 60, the blade cleaner 49 is shaped like an inverted letter V in cross section.

The operation of the mechanism associated with the blades of the ejection performance recovery device in the ink jet printing apparatus 1 of this embodiment will be described by referring to FIGS. 4 to 9.

The head face 3*a* is wiped by the blade 32, which is cleaned by a series of operations. When the blade holder 33 is moved forwardly from the state of FIG. 5 along the guide portion 35 of the base 15 in the direction of arrow B, it assumes the state of FIG. 6 where the front end of the blade 32 wipes the head face 3*a*. By moving the blade 32 to the left end of the head face 3*a*, ink and dirt adhering to the head face 3*a* are removed. When the blade 32 is moved further toward the left in the figure, the blade 32 overlaps the blade cleaner 49 which then wipes ink and dirt off the blade 32.

The operation of the blade drive mechanism will be explained in detail by referring to FIGS. 5 to 7.

Figure 6:
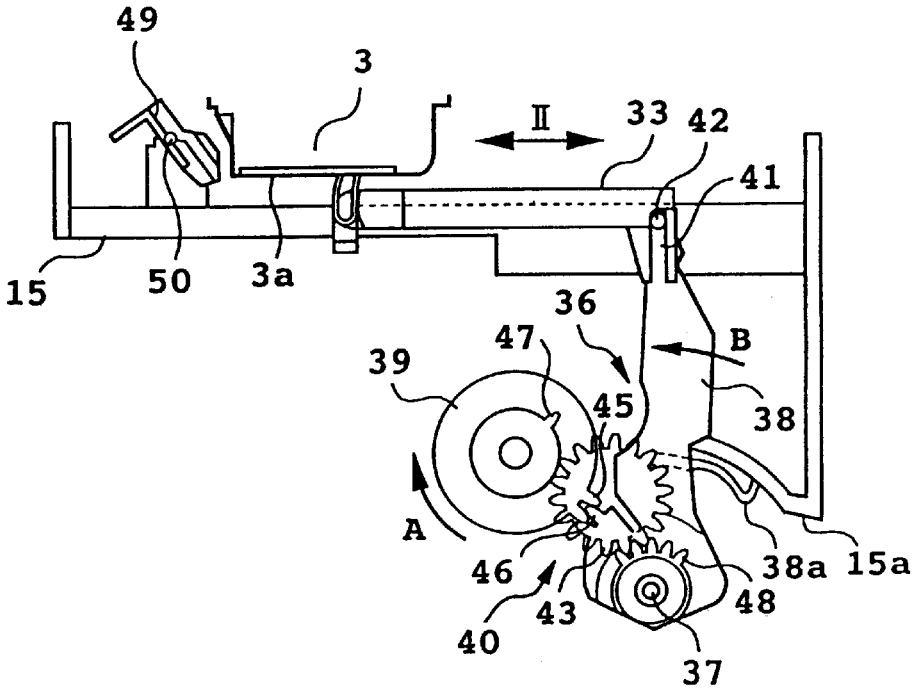
FIG. 6 is a schematic cross section showing the operation of the blade according to the embodiment of this invention.

When the drive gear 39 is rotated in the direction of arrow A from the state of FIG. 5, the gear member 45 and the gear member 46 mesh with each other to pivot the blade arm 38 in the direction of arrow B, causing the blade 32 to move toward the left in the figure to assume the state of FIG. 6. The space traveled by the front end of the blade 32 overlaps the head face 3*a*, so the blade 32 starts to wipe the head face 3*a*.

Figure 7:
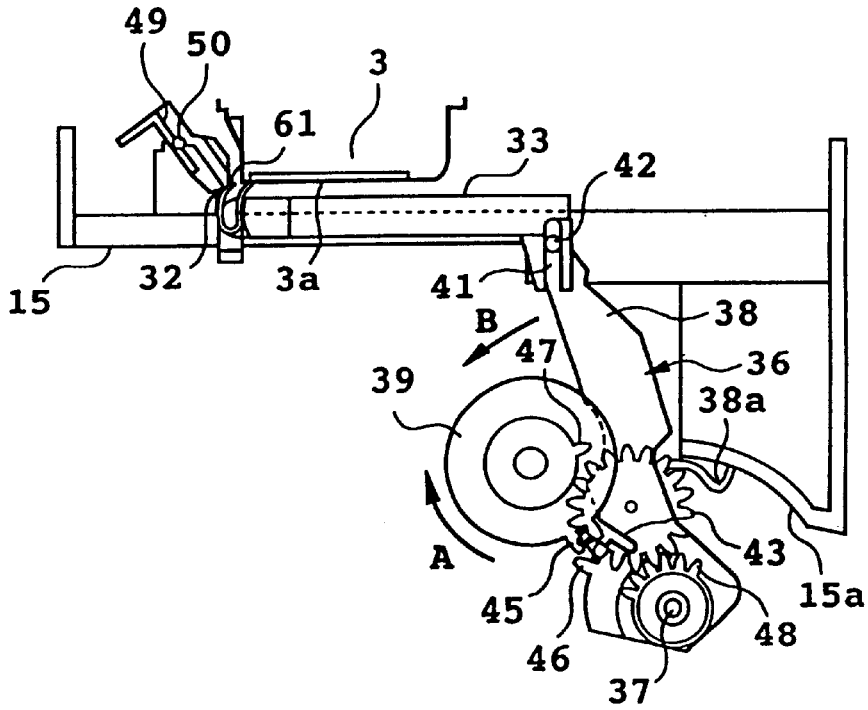
FIG. 7 is a schematic cross section showing the operation of the blade according to the embodiment of this invention.

Next, as the drive gear 39 is rotated further, the blade assumes the state of FIG. 7. The blade 32 wipes the whole head face 3*a* as it moves past the head face 3*a* until the blade 32 abuts against a cleaning portion 61 of the blade cleaner 49. Because the blade cleaner 49 is blocked by the abutting portion 53 from pivoting further, the blade 32 deflects as shown in FIG. 7 and passes under the cleaning portion 61. At this time, the ink adhering to the front end of the blade 32 is wiped off by the blade cleaner 49. In this case, because the cleaning action is performed only on the front end of the blade 32, a large portion of the ink still adheres to the blade. However, the cleaning of the head face 3*a* requires only the front end of the blade 32 to be clean and therefore the function of wiping the head face 3*a* can be performed with this construction.

Figure 8:
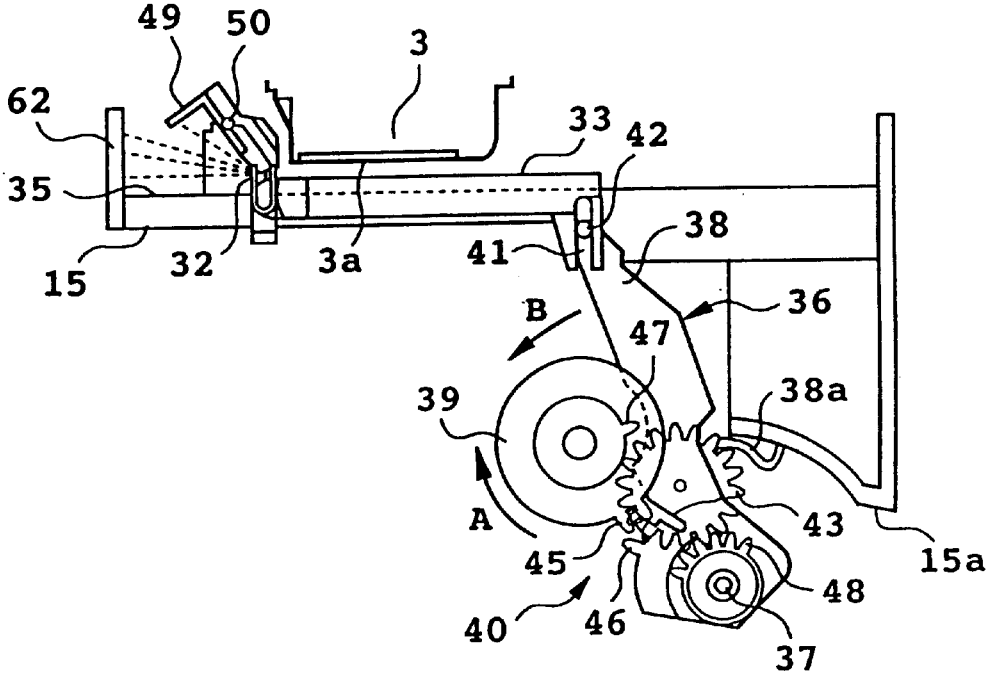
FIG. 8 is a schematic cross section showing the operation of the blade according to the embodiment of this invention.

When the blade 32 passes under the blade cleaner 49 and clears it, the external force that has deflected the blade 32 is released allowing the blade 32 to snap to its original shape, throwing away any residual ink on the blade 32 toward the left as shown in FIG. 8. If the scattering of ink by the snapping action of the blade 32 raises another problem, a wall 62 for receiving the scattered ink may be installed as close to, and on the left side of, the blade cleaner 49 as possible. It is also very effective to extend the eave-like impact portion 60 from the blade cleaner 49. However, should ink that failed to be wiped off or thrown away remain on the blade 32, this residual ink will collect at the front end of the blade holder 33.

Figure 9:
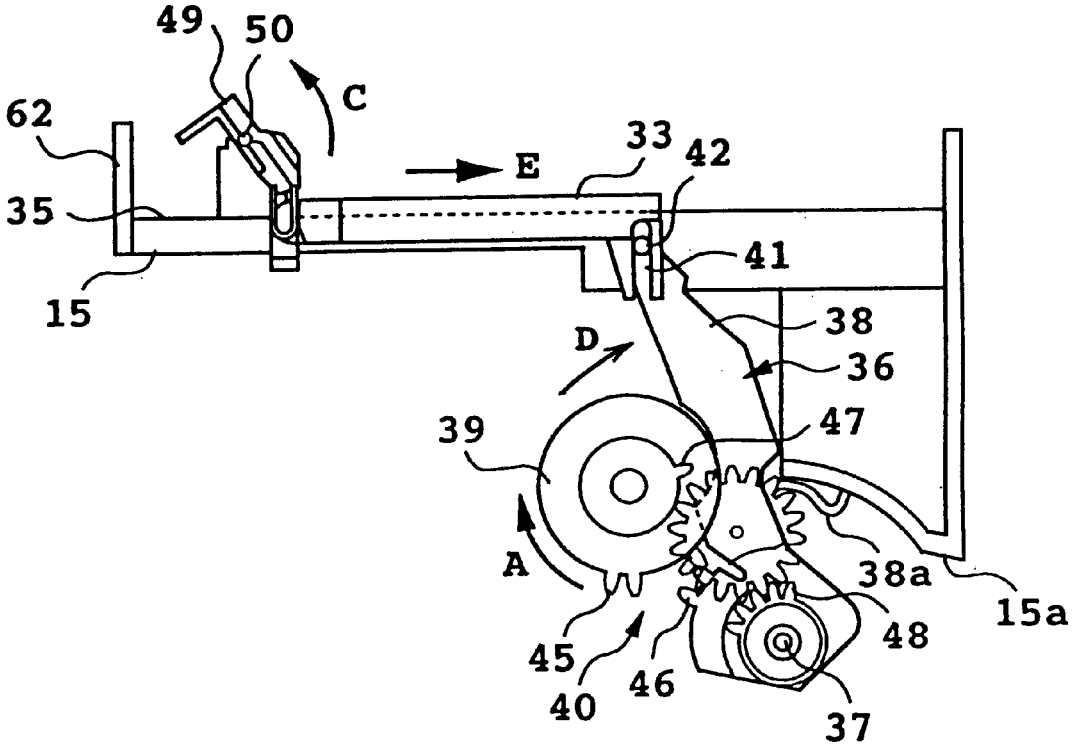
FIG. 9 is a schematic cross section showing the operation of the blade according to the embodiment of this invention.

When the drive gear 39 is rotated further, the gear portion 45 of the drive gear 39 and the gear portion 46 of the blade arm 38 disengage as shown in FIG. 9 and then the backward gear portion 47 of the drive gear 39 meshes with the backward gear portion 48 of the blade arm 38 through the idle gear 43 to transmit the drive force. Therefore, the blade arm 38 now starts to pivot backwardly in the direction of arrow D, causing the blade 32 to move in the direction of arrow E. In this case, when the blade 32 passes under the blade cleaner 49, the blade cleaner 49 pivots in the direction of arrow C to retract from the space where it overlaps the blade 32. Hence, the blade 32 pushes away the blade cleaner 49 as it moves past the blade cleaner 49. During this backward travel, the scattering of ink is greatly reduced but not eliminated completely because, strictly speaking, the blade 32 is deflected to an extent corresponding to the force of the spring 57 by which the blade cleaner 49 is biased.

If the drive gear 39 continues to be rotated, the blade 32 returns to the state of FIG. 5, completing the first wiping operation. At this time, an elastic arm portion 38*a* of the blade arm 38 falls in the trough of the cam 15*a* of the base 15, so that even if the gear member 45 of the drive gear 39 disengages from the gear member 46 of the blade arm 38 and produces no drive force, the blade arm 38 is prevented from inadvertently moving out of the position of FIG. 5.

In this way, the one-direction rotation of the stepping motor 18 results in the forward and backward movement of the blade 32, completing the cleaning of the head face 3*a* and the blade itself in one process. Because the drive gear 39 is arranged coaxial with and rotates in synchronism with the cap cam 16 which drives the cap 29, this process also constitutes one complete process of opening and closing the cap 29. In this example, the cap cam 16 and the drive gear 39, both rotating coaxially in synchronism with each other, are formed in appropriate shapes and attitudes so that the open/close operation of the cap 29 and the reciprocal motion of the blade 32 are properly staggered in their phase during one rotation of the cam and gear. Thus, the cap 29 and the blade 32 can perform their respective actions reliably without interfering with one another.

That is, the operations of the cap arm 28 supporting the cap 29 and of the blade holder 33 are alternated. In a state where the cap 29 contacts the head face 3*a*, the blade holder 33 is in a retracted position on the left as shown in FIG. 3. At this time the arm absorbing body 100 is contacted and crushed by the blade 32 and the blade holder 33. Thus, ink which accumulates on the blade 32 and the blade holder 33 is absorbed by the arm absorbing body 100. When the arm absorbing body 100 is saturated with ink, it is crushed by the blade 32, squeezing out the ink which then flows down the cap arm 28 and drips from it. Because the ink is not accumulated on the blade 32 and the blade holder 33 in large amounts, the ink on the blade 32 will not fall into the cap 29 during operation. Further, if ink drips cause any inconvenience, an appropriate ink tray may be provided at the dripping area for easy disposal of ink.

Further, when the cap 29 is open and a sufficient space is available, the blade holder 33 is moved toward the left in the figure to clean the head face 3*a* and the blade 32.

When the blade holder 33 returns to the right, the cap arm 28 moves up to perform capping. The above sequence of operations is performed in one rotation of the cam.

As described above, this embodiment provides the cap arm 28 holding the cap 29 with the absorbing body 100 in order to absorb ink that was accumulated at the lower part of the blade during the series of operations including the cap open/close operation and the wiping operation. Hence, inconveniences such as one where the ink accumulated at the lower part of the blade drips into the cap 29 can be prevented.

(In-Cap Absorbing Body)

Figure 10A:
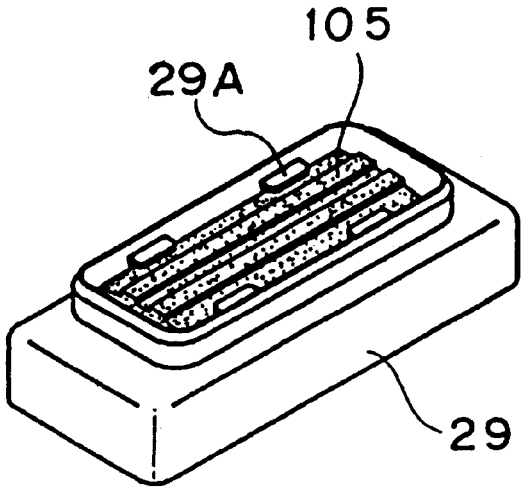
FIGS. 10A and 10B are an outline perspective view and a cross section, respectively, to explain a first example of an in-cap absorbing body applicable to the embodiment of this invention.
Figure 10B:
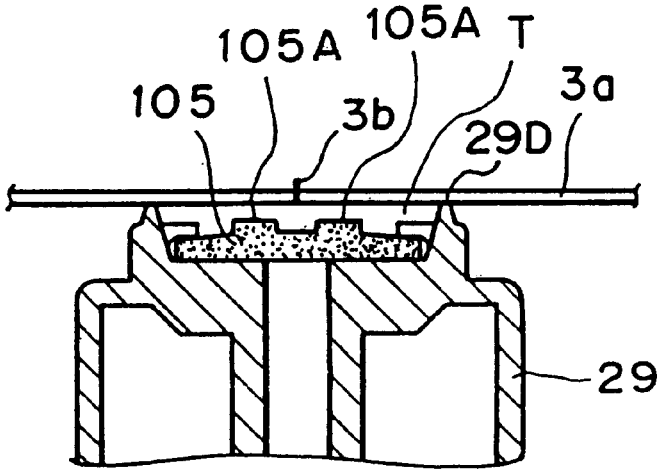

The cap 29 and the in-cap absorbing body 105 will be explained by referring to FIGS. 10 and 11. FIGS. 10 and 11 shows the first embodiment of this invention. In FIG. 10, designated 105 is an in-cap absorbing body installed in the cap 29 which is made of a porous resin with hydrophilic treatment, such as Bell Eta (trade name from Kanebo) and Sunfine (trade name from Asahikasei). The former is made by cutting a sheet-like base material and pressing it with heat to form appropriate dents in it, and the latter is made by molding with a desired shape of die.

As shown in the figures, ink orifices 3*b* of the ink jet print head 3 are formed in a plane almost flush with the head face 3*a* and the in-cap absorbing body 105 has raised portions 105A like ridges on each side of a portion facing the ink orifices. In other words, the in-cap absorbing body 105 has a recess at the portion facing the ink orifices.

Figure 11A:
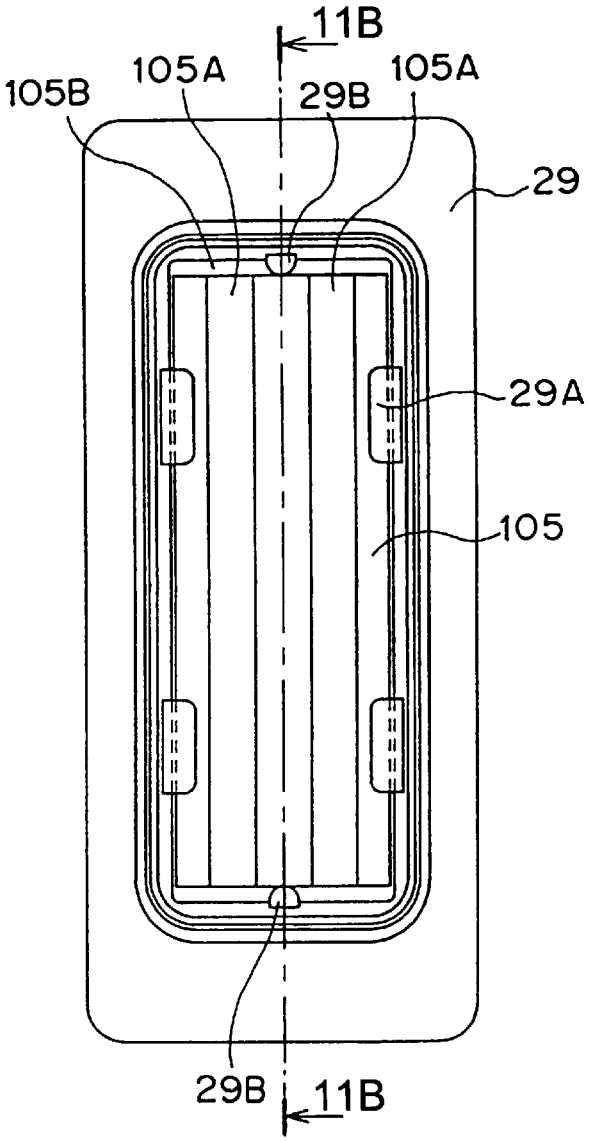
FIG. 11A is an enlarged plan view of the first embodiment of the in-cap absorbing body of FIG. 10 according to the invention and FIG. 11B is an enlarged cross section taken along the line P—P of FIG. 11A.
Figure 11B:
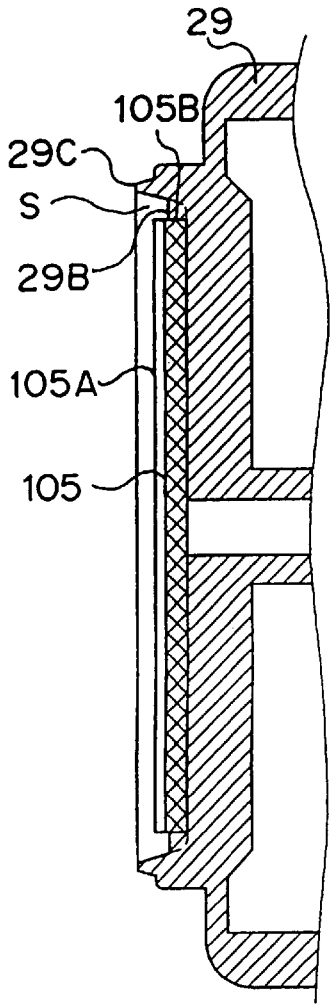

Further, FIG. 11 is an enlarged view showing the positional relation between the cap 29 of FIG. 10 and the in-cap absorbing body 105 according to the present invention. FIG. 11A is a plan view and FIG. 11B is a cross section as seen in the direction P of FIG. 11A. The in-cap absorbing body 105 is held in the cap 29 by retainers 29A formed at four locations on the cap 29. The in-cap absorbing body 105 is positioned in its longitudinal direction by setting its ends 105B against two projections 29B that function as absorbing body's position restriction members of the cap 29. As seen from FIG. 11B, the height of the projections 29B of the cap 29 is set lower than that of the raised portions 105A of the in-cap absorbing body 105.

In the construction described above, when the cap 29 is released from the head face 3*a* of the ink jet print head after the suction operation, a space S is formed between the ends 105B of the in-cap absorbing body 105 and a head engagement portion 29C of the cap 29. Further, in the cross sectional direction of FIG. 10B, a space T is also formed between the raised portions 105A and a head engagement portion 29D. This construction makes it possible to efficiently absorb ink droplets remaining on the head face 3*a*.

Figure 12A:
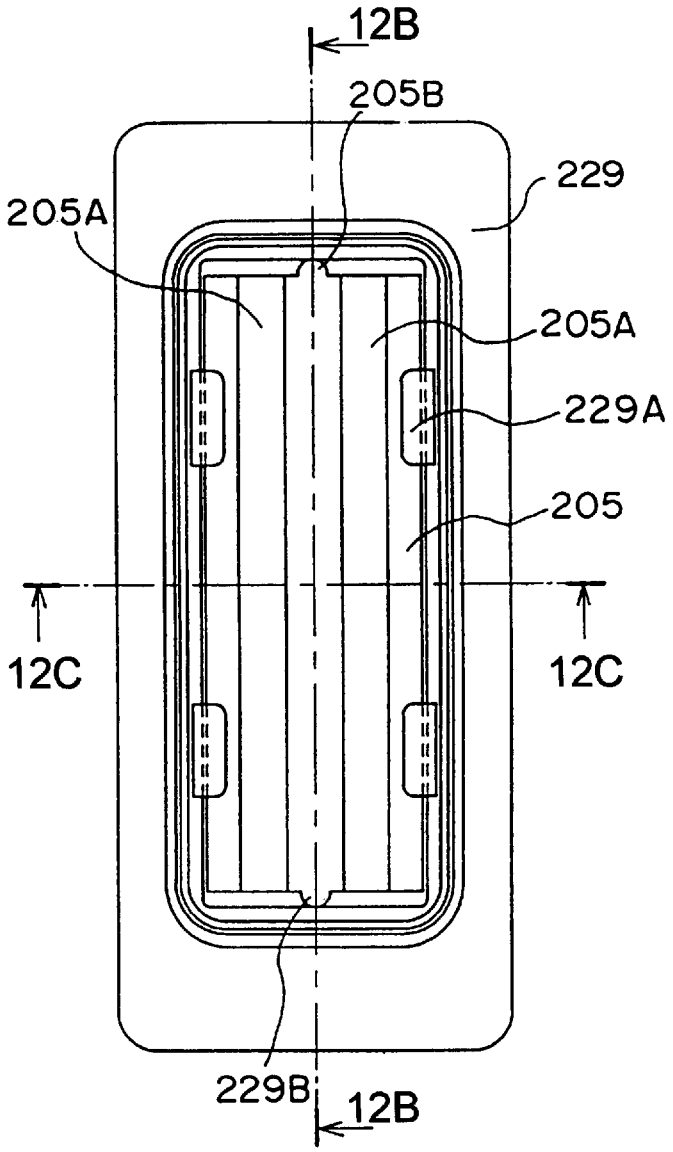
FIG. 12A is an enlarged plan view of a second embodiment of an in-cap absorbing body according to the invention.
Figure 12B:
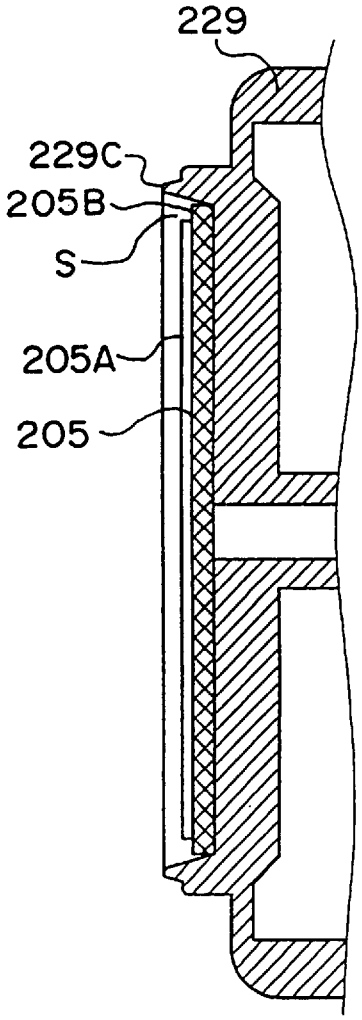
FIG. 12B is an enlarged cross section taken along the line P—P of FIG. 12A.
Figure 12C:
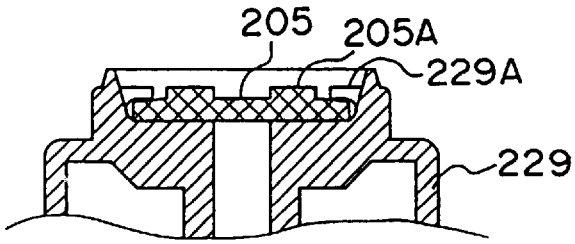
FIG. 12C is an enlarged cross section taken along the line Q—Q of FIG. 12A.

Next, a second embodiment of the present invention will be explained by referring to FIG. 12. FIG. 12A is a plan view of a cap 229 and an in-cap absorbing body 205. FIG. 12B is a cross section taken along the line P—P of FIG. 12A. FIG. 12C is a cross section taken along the line Q—Q of FIG. 12A.

As in the preceding embodiment, the in-cap absorbing body 205 is accommodated in the cap 229 and held there by retainers 229A formed at four locations on the cap 229. The in-cap absorbing body 205 has two projections 205B at longitudinal ends thereof, which as position restriction members abut against the inner wall of the cap 229, thereby determining the longitudinal position of the in-cap absorbing body 205 with respect to the cap 229. As can be seen from FIG. 12B, the height of the projections 205B of the in-cap absorbing body 205 is lower than that of raised portions 205A whose surfaces are parallel to and nearest to the head face.

With the above construction, when, after the suction operation, the cap 229 is released from the head face of the ink jet print head, a space S is formed between the ends of the in-cap absorbing body 205 and the head engagement portion 229C of the cap 229. Further, because the projections 205B near the head engagement portion 229C have an absorbing capability, the ink droplets remaining on the head face can be absorbed efficiently.

Figure 13A:
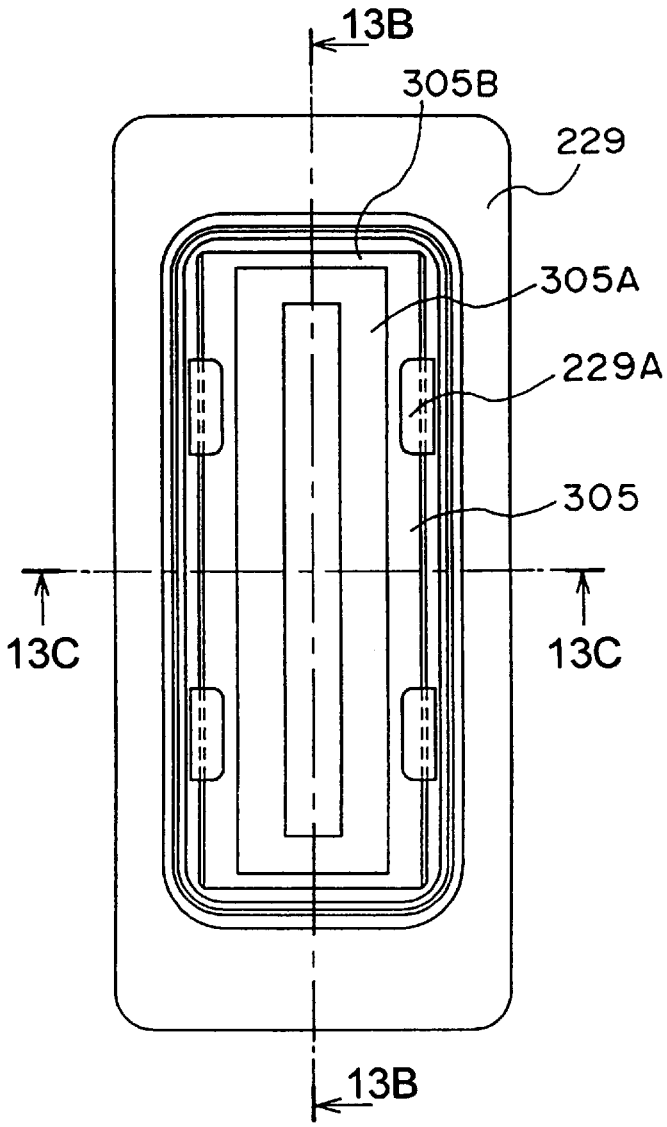
FIG. 13A is an enlarged plan view of a third embodiment of an in-cap absorbing body according to the invention.
Figure 13B:
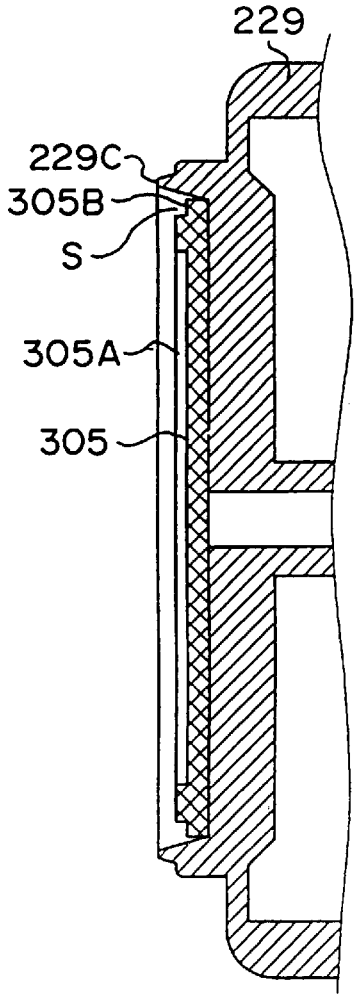
FIG. 13B is an enlarged cross section taken along the line P—P of FIG. 13A.
Figure 13C:
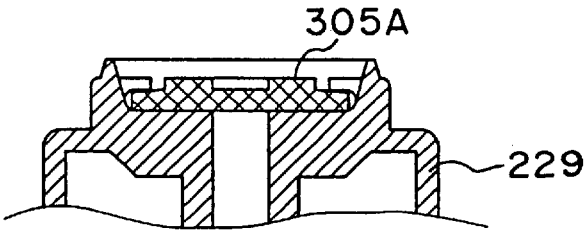
FIG. 13C is an enlarged cross section taken along the line Q—Q of FIG. 13A.

Now, a third embodiment of the invention will be described by referring to FIG. 13. FIG. 13A is a plan view of a cap 229 and an in-cap absorbing body 305. FIG. 13B is a cross section taken along the line P—P of FIG. 13A. FIG. 13C is a cross section taken along the line Q—Q of FIG. 13A.

As in the preceding embodiments, the in-cap absorbing body 305 is accommodated in the cap 229 and held there by the retainers 229A formed at four locations on the cap 229.

This embodiment has no special projections that position the in-cap absorbing body 305. The entire outer wall of the in-cap absorbing body 305 engages the inner wall of the cap 229 to determine the longitudinal position of the in-cap absorbing body 305 with respect to the cap 229.

A raised portion 305A of the in-cap absorbing body 305 is formed to encircle the nozzle portion, and along the entire outer circumference of the raised portion 305A there is formed a surface 305B which is lower in height than the raised portion 305A.

Thus, a space is formed appropriately around the entire circumference of the raised portion 305A of the in-cap absorbing body 305 between the raised portion 305A and the head engagement portion 229C of the cap 229, the raised portion 305A having a surface parallel to and nearest to the head face. The space thus formed can prevent ink droplets from remaining on the head face.

The in-cap absorbing body may use other appropriate porous materials and fiber materials. Considering such conditions as the ease of processing, dimensional precision and resistance to deformation, the materials described earlier should preferably be used.

As described above, the in-cap absorbing body according to the present invention is formed to have an appropriate shape and/or thickness so that at least a portion facing the ink orifices of the print head is raised and that, during the capping operation, the in-cap absorbing body comes close to the head face. This construction secures a space near the head engagement portion of the cap and thus can reliably collect in the space ink droplets remaining on the head face when cap is opened after the suction operation and efficiently absorb the residual ink by the in-cap absorbing body, thus effectively reducing the amount of ink adhering to the head face after the head face has undergone the ejection performance recovery operation.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus comprising:

a cap for capping ink orifices provided on a head face of an ink jet print head;

an in-cap absorbing body disposed in the cap, the in-cap absorbing body not contacting the head face during capping by the cap; and a suction means for sucking ink from the ink orifices through the cap, wherein a thickness of an end surface of the in-cap absorbing body exposed to an outside is thinner than that of a top portion of the in-cap absorbing body which is opposite to two side surfaces of the head face with respect to the ink orifices during capping by the cap, and the cap has a space formed along substantially an entire circumference of a head engagement portion of the cap between the end surface of the in-cap absorbing body and the head engagement portion of the cap.

2. An ink jet printing apparatus as claimed in claim 1, wherein position restriction portions for the in-cap absorbing body are provided in the cap and extend toward the end surface of the in-cap absorbing body.

3. An ink jet printing apparatus as claimed in claim 1, wherein position restriction portions for the in-cap absorbing body are formed integral with the in-cap absorbing body at location near the end surface of the in-cap absorbing body.

4. An ink jet printing apparatus as claimed in claim 2 or 3, wherein the height of the position restriction portions for the in-cap absorbing body is lower than that of the end surface of the in-cap absorbing body.

5. An ink jet printing apparatus as claimed in claim 1, wherein a surface which is one step lower in height than the end surface of the in-cap absorbing body is formed along an entire circumference of the in-cap absorbing body outside the end surface of the in-cap absorbing body.

6. An ink jet printing apparatus as claimed in claim 1 or 5, wherein a height of a portion of the in-cap absorbing body facing the ink orifices of the ink jet print head is lower than that of the end surface of the in-cap absorbing body.

7. An ink jet printing apparatus as claimed in claim 2 or 3, wherein a portion of the in-cap absorbing body facing an array of the ink orifices of the ink jet print head and a portion of the in-cap absorbing body restricted by the position restriction portions are lower in height than the end surface of the in-cap absorbing body and wherein the position restriction portions are provided at longitudinal ends of the in-cap absorbing body.

8. An ink jet printing apparatus as claimed in claim 1, wherein the in-cap absorbing body is formed of a porous material.

9. An ink jet printing apparatus as claimed in claim 1, wherein the ink jet print head has an electrothermal transducer for generating thermal energy to eject ink.

10. An ink jet printing apparatus as claimed in claim 9, wherein the ink jet print head uses thermal energy to generate a bubble based on a film-boiling in ink to eject an ink droplet.

11. A cap of an ink jet print head for capping a head face of the ink jet print head, the cap comprising:

an in-cap absorbing body installed in an interior of the cap, the in-cap absorbing body not contacting the head face during capping by the cap, wherein a thickness of an end surface of the in-cap absorbing body exposed to an outside is thinner than that of a top portion of the in-cap absorbing body which is opposite to two side surfaces of the head face with respect to the ink orifices during capping by the cap, and the cap has a space formed along substantially an entire circumference of a head engagement portion of the cap between the end surface of the in-cap absorbing body and the head engagement portion of the cap.

12. An ink jet printing apparatus comprising:

a cap for capping ink orifices provided on a head face of an ink jet print head;

an in-cap absorbing body disposed in the cap, the in-cap absorbing body not contacting the head face during capping by the cap; and a suction means for sucking ink from the ink orifices through the cap, wherein a height of an end surface of the in-cap absorbing body exposed to an outside is higher than that of a top portion of the in-cap absorbing body which is opposite to two side surfaces of the head face with respect to the ink orifices during capping by the cap, and the cap has a space formed along substantially an entire circumference of a head engagement portion of the cap between the end surface of the in-cap absorbing body and the head engagement portion of the cap.

13. A cap of an ink jet print head for capping a head face of the ink jet print head, the cap comprising:

an in-cap absorbing body installed in an interior of the cap, the in-cap absorbing body not contacting the head face during capping by the cap, wherein a height of an end surface of the in-cap absorbing body exposed to an outside is higher than that of a top portion of the in-cap absorbing body which is opposite to two side surfaces of the head face with respect to the ink orifices during capping by the cap, and the cap has a space formed along substantially an entire circumference of a head engagement portion of the cap between the end surface of the in-cap absorbing body and the head engagement portion of the cap.

* * * * *

UNITED STATES PATENT AND TRADEMARK OFFICE

CERTIFICATE OF CORRECTION

PATENT NO. : 6,550,890 B2
DATED : April 22, 2003
INVENTOR(S) : Saijo

It is certified that error appears in the above-identified patent and that said Letters Patent is hereby corrected as shown below:

Column 2,
Line 11, “an” should read -- a --;
Line 17, “link” should read -- ink --; and
Line 24, “failures”” should read -- failure” --.

Column 3,
Line 17, “comprising,” should read -- comprising: --;
Line 19, “head,” should read -- head; --; and
Line 20, “cap,” should read -- cap; --.

Column 9,
Line 2, “elongate” should read -- elongated --; and
Line 51, “so” should read -- so that --.

Column 10,
Line 40, “movement” should read -- movements --.

Column 11,
Line 20, “shows” should read -- show --;
Line 27, “molding” should read -- molding it --; and
Line 51, “cross” should read -- cross- --.

Column 13,
Line 45, “consists” should read -- consist --.

Column 15,
Line 10, “location” should read -- a location --.

Signed and Sealed this

Fourth Day of November, 2003

JAMES E. ROGAN
*Director of the United States Patent and Trademark Office*